US005540139A

United States Patent [19]

Martensen et al.

[11] Patent Number: 5,540,139

[45] Date of Patent: Jul. 30, 1996

[54] HYDRAULIC AXIAL PISTON MACHINE

[75] Inventors: Lars Martensen, Sonderborg; Hardy P. Jepsen, Nordborg, both of Denmark

[73] Assignee: Danfoss A/S, Nordborg, Denmark

[21] Appl. No.: 464,685

[22] PCT Filed: Jan. 5, 1994

[86] PCT No.: PCT/DK94/00006

§ 371 Date: Jun. 6, 1995

§ 102(e) Date: Jun. 6, 1995

[87] PCT Pub. No.: WO94/16219

PCT Pub. Date: Jul. 21, 1994

[30] Foreign Application Priority Data

Jan. 18, 1993 [DE] Germany ..... 43 01 134.9

[51] Int. Cl.[6] ..... F01B 13/04

[52] U.S. Cl. ..... 92/57; 417/269; 74/60

[58] Field of Search ..... 92/57, 71; 91/499; 417/269; 74/60

[56] References Cited

U.S. PATENT DOCUMENTS 3,131,605 5/1964 La Borde ..... 92/57

4,838,765 6/1989 Wusthof et al. ..... 417/269

*Primary Examiner*—Thomas E. Denion

*Attorney, Agent, or Firm*—Lee, Mann, Smith, McWilliams, Sweeney & Ohlson

[57] ABSTRACT

A hydraulic axial piston machine is disclosed, with a cylinder drum (2), which has at least one cylinder (3), in which a piston (6) is mounted so as to be axially displaceable, and with a control counter-plate (11) which, on rotation of the cylinder drum (2) and the control counter-plate (11) relative to one another, connects the cylinder (3) in dependence upon its position with a fluid inlet (14) and a fluid outlet (15). With a machine of that kind, it is desirable to improve balancing out of the forces necessary for effecting a seal between the cylinder drum (3) and the control counter-plate (11). For that purpose, between the cylinder drum (2) and the control counter-plate (11) there is arranged a pressure plate (17) which engages the cylinder drum (2) via the intermediary of a spring element (21), the pressure plate (17) having a through-opening (20) associated with the cylinder (3), which through-opening is connected to the cylinder (3) in a fluid-tight manner.

10 Claims, 1 Drawing Sheet

HYDRAULIC AXIAL PISTON MACHINE

Figure 1:
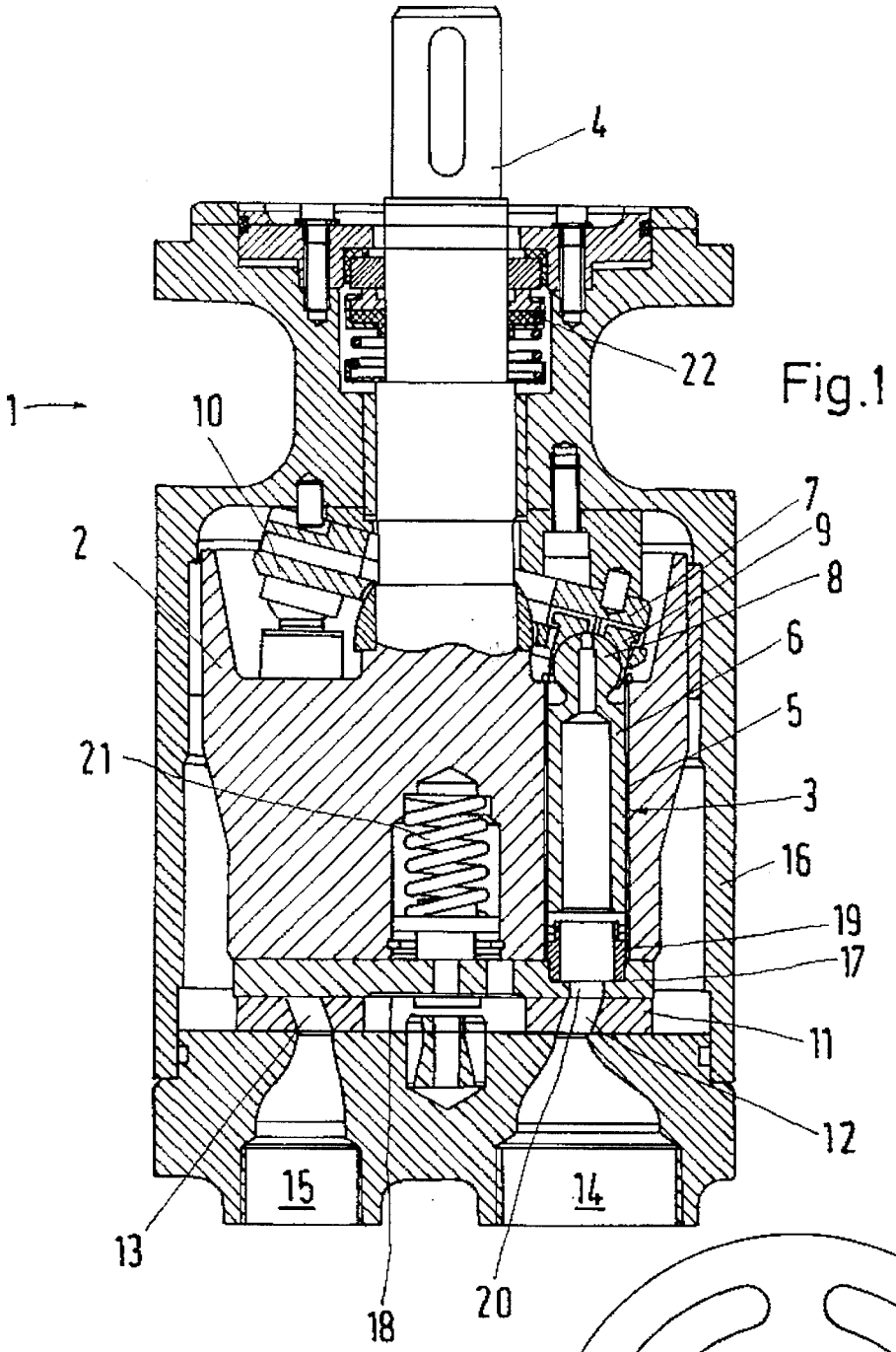

The invention relates to a hydraulic axial piston machine with a cylinder drum, which has at least one cylinder, in which a piston is mounted so as to be axially displaceable, and with a control counter-plate which on rotation of the cylinder drum and the control counter-plate relative to one another connects the cylinder in dependence upon its position with a fluid inlet and a fluid outlet.

The control counter-plate normally has arcuate or kidney-shaped control slots of which one, which is arranged in a region in which the piston moves away from the control counter-plate, is connected to the fluid inlet, while the other, which is arranged in another region in which the piston moves towards the control counter-plate, is connected to the fluid outlet. To prevent the fluid flowing out of or into the cylinder from escaping laterally, that is, to ensure that the fluid flows only from the cylinder to the fluid outlet or from the fluid inlet to the cylinder, the cylinder drum is pressed against the control counter-plate with a certain force. This force is produced by the pressure prevailing in the cylinder which acts on a part of the cylinder end face, optionally assisted by a compression spring, which also presses the cylinder drum against the control counter-plate. The control slots are only partially masked by the end-face openings of the cylinder. Areas remain in which the slots is masked by the end face of the cylinder drum, namely, in the region between the end-face cylinder openings. In these regions the pressure in the cylinders acts in the opposing direction, that is, in a direction to lift the cylinder drum away from the control counter-plate. Thus one seeks to equalise the forces acting on the cylinder drum from the two opposing directions so that the cylinder drum is pressed with the required force against the control counter-plate. The force on the cylinder drum generated by the pressure in the control slots therefore has to be less than the force acting in the opposing direction. This can be achieved, for example, by giving the faces on which the pressure acts suitable dimensions.

In practice, however, it is relatively difficult to achieve the correct equilibrium of forces because, inter alia, frictional forces act between the piston and the cylinder, and exert on the cylinder drum additional tensile or pressure forces, as seen from the cylinder drum looking towards the control counter-plate. These forces can be managed only with difficulty. They are in some cases temperature-dependent and override in particular the forces that are exerted by the pressure of the hydraulic fluid on the cylinder drum. Instabilities can then occur which lead on the one hand to an increased contact pressure between the cylinder drum and the control counter-plate, resulting in a reduction in mechanical efficiency, and on the other hand lift the cylinder drum away from the control counter-plate, resulting in a reduction in the volumetric efficiency. Both cases are undesirable. If such operating conditions occur repeatedly in succession, they can lead to increased wear and tear or even to destruction of the machine.

The invention is therefore based on the problem of equalizing the forces on the control counter-plate in a simple and improved manner.

This problem is solved in a hydraulic axial piston machine of the kind mentioned in the introduction in that between the cylinder drum and the control counter-plate there is arranged a pressure plate which engages the cylinder drum via the intermediary of a spring element, the pressure plate having a through-opening associated with the cylinder, which through-opening is connected to the cylinder in a fluid-tight manner.

A single additional element is therefore joined to the cylinder drum by way of a spring. The spring separates the cylinder drum and the pressure plate. This means that stray forces which arise, for example from friction of the piston in the cylinder, are no longer transmitted directly to the control counter-plate but are absorbed by the spring or by bearings. The forces which still require to be equalized are caused exclusively by the pressure of the spring and the hydraulic pressure in the cylinder. These forces can be relatively accurately determined, however, so that a state of equilibrium can be calculated and set in advance.

In an advantageous construction the spring element is formed by a single spring which is arranged in the radial centre of the cylinder drum. The spring thus also forms a rocker joint so that slight rocking movements of the cylinder drum, which can be caused by an uneven distribution of pressure, cannot be transmitted to the pressure plate.

A connector bush is preferably provided to connect the cylinder and through-opening, which connector bush is arranged to be axially displaceable in the cylinder and/or in the through-opening. A connector bush of this kind guarantees a fluid-tight connection in a simple manner, even if relatively small movements between the cylinder drum and the pressure plate have to be allowed. Of course, the connector bush then has to be guided, sealed, in the part in which it moves. This can be achieved, however, through relatively simply constructed ring seals.

The connector bush is in this connection preferably fixed either in the cylinder drum or in the pressure plate. At least in conjunction with one of these two parts the position of the connector bush is defined. This prevents the connector bush from drifting out of place. The connector bush can be soldered or sintered to the appropriate part, for example. It can be fixed by a press fit in the part. Other connections which create a defined position of the connector bush in the particular part are likewise possible.

The connector bush is preferably, however, of integral construction with the pressure plate. This simplifies manufacture.

In an advantageous construction the cylinder is formed with a bushing, the connector bush projecting into the inside of the bushing. In this manner, no hydraulic pressure forces are able to act on the front ends of the bushing. Axial forces which are exerted by the pressure in the hydraulic fluid on the bushings are consequently reliably excluded. The bushings are stressed in the axial direction virtually only by frictional forces between the piston and the bushing. The bushings therefore no longer require such a large holding force in the axial direction. It is accordingly possible to use bushing material which can be fixed with only a relatively low holding force, for example, bushings purely of plastics or ceramics or other materials or combinations of materials which are relatively brittle or are provided with a smooth but brittle surface. Having more freedom in the choice of material for the bush, it is possible to select suitable combinations of material for the bush[2] and the piston even when the hydraulic fluid has no or only slight lubricating properties.

The pressure plate preferably has, at least in the region in which it engages the control counter-plate, a friction-reducing surface layer, especially of plastics material. This also means that lubrication by means of the hydraulic fluid can be largely or even completely dispensed with. The group of available hydraulic fluids is therefore considerably enlarged. One can dispense with synthetic hydraulic oils harmful to the environment.

In this connection it is especially preferable for the pressure plate to be completely surrounded by the surface layer. There are no gaps or holes though which the hydraulic fluid could penetrate and get between the surface layer and the pressure plate. Fluid that penetrates could damage the surface layer and lead sooner or later to failure of the machine.

In another construction, the pressure plate is formed from plastics material. This plastics material is preferably, like the material of the surface layer, selected so that together with the material of the control counter-plate it allows low-friction sliding even under relatively large forces. Examples of plastics materials which may be considered for the pressure plate or for the surface layer are, in particular, materials from the group of high-strength thermoplastic plastics materials on the basis of polyaryl ether ketones, in particular polyether ether ketones, polyamides, polyacetals, polyaryl ethers, polyethylene terephthalates, polyphenylene sulphides, polysulphones, polyether sulphones, polyether imides, polyamide imide, polyacrylates, phenol resins, such as novolak resins, or similar substances, and as fillers, use can be made of glass, graphite, polytetrafluoroethylene or carbon, in particular in fibre form. When using such materials, it is likewise possible to use water as the hydraulic fluid.

In a further alternative construction, the pressure plate can be formed from sintered metal. Here too, suitable combinations of the materials of the pressure plate and control counter-plate can be achieved which permit low-friction sliding contact during the relative movement of the pressure plate and control counter-plate, so that lubrication by means of the hydraulic fluid can largely be eliminated.

Figure 2:
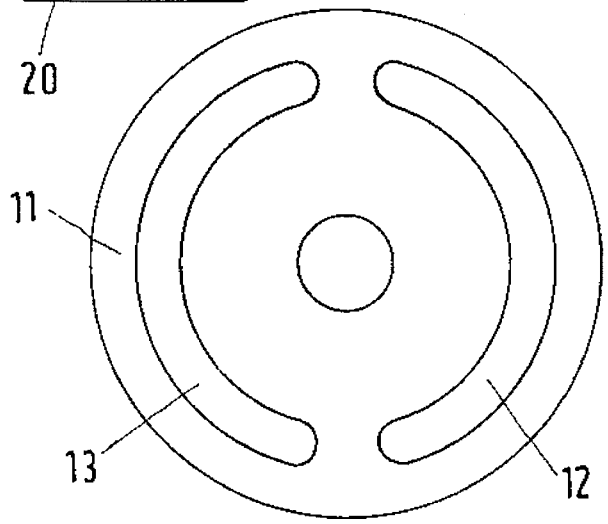

The invention is described hereinafter with reference to a preferred embodiment in conjunction with the drawing, in which FIG. 1 shows a cross-section through a hydraulic axial piston machine, and FIG. 2 shows a plan view of a control counter-plate.

A hydraulic axial piston machine 1 has a cylinder drum 2 in which several cylinders 3 with axes extending parallel to the axis of the cylinder drum 2 are arranged. The cylinder drum 2 is fixedly connected to a shaft 4, that is to say, it follows rotary movement of the shaft 4 and is also fixed in the axial direction of the shaft.

Each cylinder 3 has a bushing 5. A piston 6 is arranged so as to be axially displaceable in the bushing 5. The movement of the piston 6 is effected by way of a slanting plate 7 against which the piston 6 bears by way of a ball-and-socket joint 8 by means of a slider shoe 9. The slider shoe 9 is held on the slanting plate 7 by means of a holding-down plate 10.

At the other end of the machine there is arranged a control counter-plate 11 which has two arcuate or kidney-shaped control openings 12, 13, one of which is connected to an inlet connection 14 and the other of which is connected to an outlet connection 15. The control counter-plate 11 is fixedly arranged in the housing 16 whereas the cylinder drum 2 rotates in the housing.

The control opening 12 connected to the inlet connection 14 is arranged in a region in which the piston 6 in the cylinder drum 2 moves away from the control counter-plate 11. The control opening 13 connected to the outlet connection 15 is arranged in another region, in which the piston 6 moves towards the control counter-plate 11.

Between the control counter-plate 11 and the cylinder drum 2 there is a pressure plate 17 which is enclosed, at least on the side facing the control counter-plate 11, and preferably entirely, by a friction-reducing surface layer 18. The material of the surface layer 18, preferably a plastics material, such as polyamide, PTFE or polyarylether ketone, especially polyether ether ketone (PEEK) is matched to the material of the control counter-plate 11 to give low-friction sliding contact, that is to say, the relative movement between control counter-plate 11 and pressure plate 17 causes no noticeable frictional forces.

A connector bush 19 is arranged in the pressure plate 17, namely, in a through-opening 20, which in turn can be caused to coincide with the control openings 12, 13. The connector bush 19 is inserted with its other end in the cylinder 3, in fact into the inside of the bushing 5. Hydraulic fluid is therefore unable to gain access to the front end of the bushing 5.

The pressure plate 17 is combined by way of a compression spring 21 with the cylinder drum 2. In place of a single compression spring 21 in the axial centre, three or more springs can be used which are distributed substantially point-symmetrically in the cylinder drum 2. A wave spring passing externally around the cylinders is likewise possible.

The cylinder drum 2 is pushed upwards by the compression spring 21, that is to say, away from the control counter-plate 11. This causes the cylinder drum 2 and the pressure plate 17 to separate from one another. As a result, first of all a disconnection of the cylinder drum 2 and the pressure plate 17 in respect of movement is achieved. The cylinder drum 2 can now also, depending on the application, be mounted fixedly in the axial direction in the housing 16 so that forces such as frictional forces between piston 6 and cylinder 3 can be absorbed by bearings 22, that is to say, do not lead to disruption of the force equilibrium at the pressure plate 17. By this means, not only can the forces be theoretically better equalized, but in practice balance can also be adjusted considerably more easily.

The connector bush 19 is inserted in the bushing 5 and sealed there. It prevents hydraulic fluid getting to the front end of the bushing 5. By this means the hydraulic fluid is additionally prevented from exerting axial forces on the bushing 5. The bushing 5 can therefore be fixed in the cylinder 3 with a considerably lower holding force. This holding force need only be sufficient for the forces exerted on the bushing 5 by the piston 6 to be absorbed. Materials that have a good frictional behaviour in combination with the piston 6 but would otherwise not be well-suited because they are too brittle, can now also be used for the bushing 5. For example, bushings purely of plastics material or ceramics can now be used.

The pressure plate 17 and the bushing 19 can be manufactured from different materials, the connector bush 19, however, being fixed in the pressure plate 17. Pressure plate 17 and connector bush 19 can be manufactured purely from plastics material. They can also be manufactured from material sheathed in plastics material. Alternatively, two metal parts which are assembled by means of a press fit or soldered or sintered together can be used.

Finally, the pressure plate and the connector bush 19 can be manufactured as one piece, for example from metal, which has been cast or sintered.

FIG. 1 shows just one cylinder 3 in cross-section. It is to be understood that a plurality of cylinders can be provided in the circumferential direction of the cylinder drum. In particular at least one cylinder should be connected to the inlet and at least one cylinder should be connected to the outlet.

We claim:

1. A hydraulic axial piston machine with a cylinder drum, having at least one cylinder in which a piston is mounted so as to be axially displaceable, a control counter-plate which, on rotation of the cylinder drum and the control counter-plate relative to one another, connects the cylinder in dependence upon its position with a fluid inlet and a fluid outlet, and having a pressure plate situated between the cylinder drum and the control counter-plate, said pressure plate having a through-opening associated with the cylinder, which through-opening is connected to the cylinder via a connector bush in a fluid-tight manner, the cylinder being formed with a bushing, the connector bush projecting into the inside of the bushing.

2. A machine according to claim 1, in which the pressure plate engages the cylinder drum via the intermediary of a spring element.

3. A machine according to claim 2, in which the spring element is formed by a single spring which is arranged in the radial center of the cylinder drum.

4. A machine according to claim 1, in which the connector bush connects the cylinder and through-opening, said connector bush being axially displaceable in at least one of the cylinder and the through-opening.

5. A machine according to claim 4, in which the connector bush is fixed in one of the cylinder drum or the pressure plate.

6. A machine according to claim 5, in which the connector bush is of integral construction with the pressure plate.

7. A machine according claim 1, in which the pressure plate has, at least in a region in which it engages the control counter-plate, a friction-reducing surface layer of plastic material.

8. A machine according to claim 7, in which the pressure plate is completely surrounded by the surface layer.

9. A machine according to claim 1, in which the pressure plate is formed from plastic material.

10. A machine according to claim 1, in which the pressure plate is formed from sintered metal.

* * * * *